US009599122B2

(12) United States Patent
Tamaoka et al.

(10) Patent No.: US 9,599,122 B2
(45) **Date of Patent: *Mar. 21, 2017**

(54) BLOWER FAN

(71) Applicant: NIDEC CORPORATION, Kyoto (JP)

(72) Inventors: Takehito Tamaoka, Kyoto (JP); Kazuhiko Fukushima, Kyoto (JP); Kyoko Horise, Kyoto (JP); Shinya Ishigami, Kyoto (JP); Takahiro Nagai, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 752 days.

This patent is subject to a terminal disclaimer.

(21) Appl. No.: 14/030,633

(22) Filed: Sep. 18, 2013

(65) Prior Publication Data

US 2014/0178186 A1 Jun. 26, 2014

(30) Foreign Application Priority Data

Dec. 25, 2012 (JP) ..... 2012-280956

(51) Int. Cl.
*F04D 29/42* (2006.01)
*F04D 17/16* (2006.01)
*F04D 25/06* (2006.01)

(52) U.S. Cl.
CPC ..... *F04D 29/422* (2013.01); *F04D 17/16* (2013.01); *F04D 25/0613* (2013.01)

(58) Field of Classification Search
CPC ..... F04D 17/16; F04D 25/0613; F04D 25/08; F04D 29/4206; F04D 29/422; F04D 29/4226; F04D 29/441; F04D 29/661
See application file for complete search history.

(56) References Cited

U.S. PATENT DOCUMENTS 6,827,555 B2 * 12/2004 Yang ..... F04D 29/30 416/197 R
7,207,774 B2 4/2007 Kashiwazaki et al.
2003/0039545 A1 2/2003 Hirata
2010/0074742 A1 * 3/2010 Koo ..... F04D 29/422 415/204

(Continued)

FOREIGN PATENT DOCUMENTS

CN 102213488 A 10/2011
JP S5313610 U * 2/1978

(Continued)

*Primary Examiner* — Craig Kim
*Assistant Examiner* — Juan G Flores
(74) *Attorney, Agent, or Firm* — Westerman, Hattori, Daniels & Adrian, LLP

(57) ABSTRACT

In a blower fan according to a preferred embodiment of the present invention, a side wall portion includes a tongue portion arranged to project between an air outlet and an impeller. A side surface of the tongue portion includes a tongue portion tip arranged to touch a first imaginary plane including a central axis; a first tongue portion side surface arranged to extend from the tongue portion tip along an outer envelope of the impeller; and a second tongue portion side surface arranged to extend from the tongue portion tip toward a side edge, the side edge being a line of intersection of the air outlet and the side wall portion. The second tongue portion side surface is arranged to cross a second imaginary plane including the central axis and touching the side edge.

19 Claims, 10 Drawing Sheets

(56) References Cited

U.S. PATENT DOCUMENTS

| | | | | |
|---|---|---|---|---|
| 2011/0058938 | A1* | 3/2011 | Chen | F04D 29/4226 415/206 |
| 2012/0148394 | A1 | 6/2012 | Lin et al. | |
| 2013/0143479 | A1 | 6/2013 | Weng et al. | |

FOREIGN PATENT DOCUMENTS

| | | | |
|---|---|---|---|
| JP | 2003069265 | A | 3/2003 |
| JP | 2004019636 | A | 1/2004 |
| JP | 2005-291049 | A | 10/2005 |
| JP | 2008-133761 | A | 6/2008 |
| JP | 2008267242 | A | 11/2008 |
| JP | 2012-107577 | A | 6/2012 |
| JP | 2013-524160 | A | 6/2013 |
| WO | 2011/127741 | A1 | 10/2011 |

* cited by examiner

BLOWER FAN

BACKGROUND OF THE INVENTION

1. Field of the Invention

The present invention relates to a blower fan.

2. Description of the Related Art

Small and high-performance electronic devices, such as notebook PCs, produce a large amount of heat at CPUs and the like inside cases thereof. This makes it important to take measures against the heat. One common measure against the heat is to install blower fans inside the cases to discharge the heat. Meanwhile, there has been a demand for a reduction in thickness of the notebook PCs. Accordingly, the blower fans have been required to be reduced in thickness while reducing a deterioration in air-blowing performance.

Therefore, attempts have been made to reduce the height of blades of impellers to achieve a reduction in the thickness of the blower fans, and at the same time to increase the rotation rate of the blades to reduce the deterioration in the air-blowing performance. An increase in the rotation rate of the blades leads to increases in wind noise, noise caused by interference of a wind with a housing, and the like. Accordingly, it is important to reduce noise of such blower fans.

JP-A 2012-107577, for example, discloses a technique for an effective reduction in noise. According to this technique, a raised portion is provided in a surface of each of a plurality of blades, the surface facing rearward against a rotation direction of the blades, to prevent a vacuum from being generated in the vicinity of a surface of each blade, and furthermore, noises caused by winds propelled by the blades are caused to have a plurality of different types of frequencies and waveforms, whereby the effective reduction in noise is achieved.

Meanwhile, in a centrifugal fan disclosed in US 2012/0148394, a tongue portion is provided in an arc sidewall of a flowing channel in the vicinity of an air outlet defined in a side surface of a case. In a casing of a centrifugal fan disclosed in JP-A 2005-291049, a nose tongue of an outlet port includes an arc-shaped surface arranged to spread toward an end of the outlet port. In a multi-blade centrifugal fan disclosed in Japanese Patent No. 4183005, an inner surface of a scroll casing is in the shape of a logarithmic spiral given by $Rs(\theta s)=r\cdot\exp(((\theta s+(\beta)\cdot\tan\alpha)$, where $\theta s$ is a central angle measured from a tongue portion of the scroll casing, Rs is the inside diameter of the scroll casing at the central angle ($\theta s$), r is the inside diameter of the scroll casing at the tongue portion, $\beta$ is a correction value for the central angle ($\theta s$) of the scroll casing, and $\alpha$ is the enlargement ratio of the scroll casing.

In a blower fan whose housing is provided with the tongue portion, a noise is generated by interference of a wind sent from an impeller toward an air outlet with the tongue portion.

SUMMARY OF THE INVENTION

A blower fan according to a preferred embodiment of the present invention includes an impeller centered on a central axis extending in a vertical direction; a motor portion arranged to rotate the impeller about the central axis; and a housing arranged to house the impeller. The housing includes a lower plate portion arranged to cover a lower side of the impeller, and arranged to have the motor portion fixed thereto; and a side wall portion arranged to cover a lateral side of the impeller. The lower plate portion or an upper plate portion arranged to cover an upper side of the impeller includes an air inlet. The upper plate portion, the side wall portion, and the lower plate portion are arranged to together define an air channel portion arranged to surround the impeller. The upper plate portion, the side wall portion, and the lower plate portion are arranged to together define an air outlet on the lateral side of the impeller. The air outlet is planar and parallel to the central axis, and includes one of an edge of the upper plate portion, a pair of edges of the side wall portion, and an edge of the lower plate portion that is closest to the central axis. The side wall portion includes a tongue portion arranged to project between the air outlet and the impeller. A side surface of the tongue portion includes a tongue portion tip arranged to touch a first imaginary plane including the central axis; a first tongue portion side surface arranged to extend from the tongue portion tip along an outer envelope of the impeller; and a second tongue portion side surface arranged to extend from the tongue portion tip toward a side edge, the side edge being a line of intersection of the air outlet and the side wall portion. The second tongue portion side surface is arranged to cross a second imaginary plane including the central axis and touching the side edge. A closest proximity position, at which the first tongue portion side surface and the outer envelope are in closest proximity to each other, is located between the first imaginary plane and a third imaginary plane including the central axis and touching the second tongue portion side surface between the tongue portion tip and the side edge.

The present invention is able to achieve a reduction in noise caused by interference of a wind sent from the impeller with the tongue portion.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
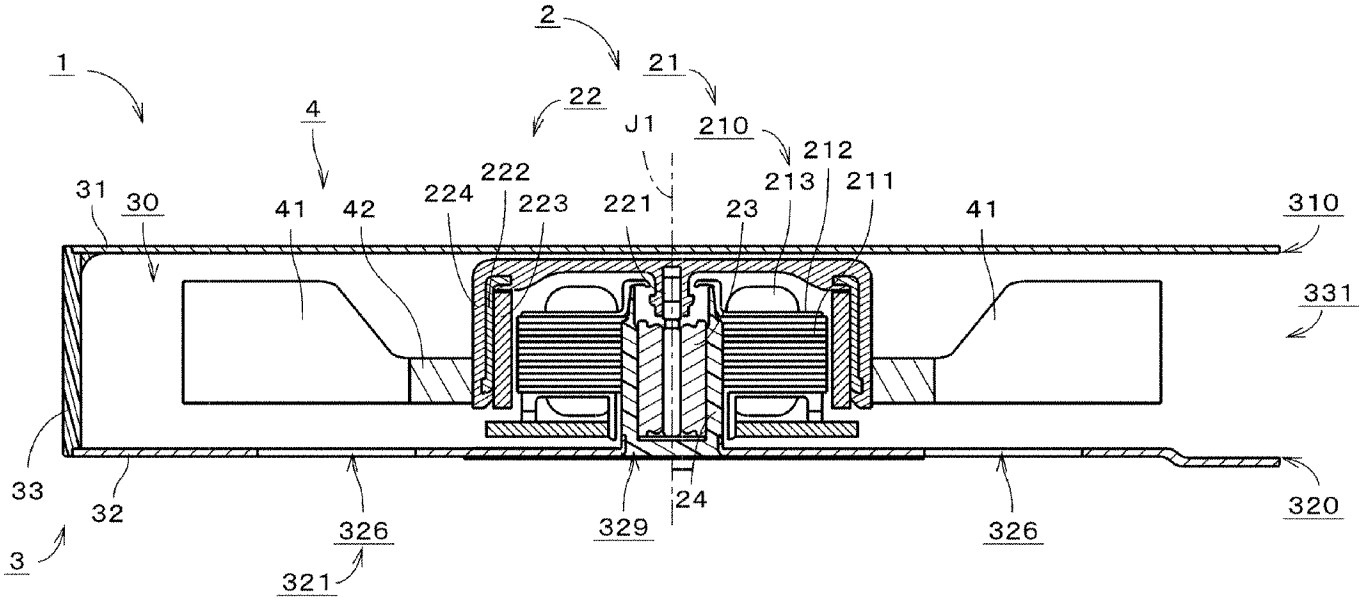
FIG. 1 is a cross-sectional view of a blower fan according to a first preferred embodiment of the present invention.

It is assumed herein that an upper side and a lower side in a direction parallel to a central axis of a blower fan illustrated in FIG. 1 are referred to simply as an upper side and a lower side, respectively. Note that a vertical direction assumed herein may not necessarily correspond with a vertical direction of the blower fan when the blower fan is actually installed in a device. It is also assumed herein that a circumferential direction about the central axis is simply referred to by the term "circumferential direction", "circumferential", or "circumferentially", that radial directions centered on the central axis are simply referred to by the term "radial direction", "radial", or "radially", and that the direction parallel to the central axis is simply referred to by the term "axial direction", "axial", or "axially".

First Preferred Embodiment

FIG. 1 is a cross-sectional view of a blower fan 1 according to a first preferred embodiment of the present invention. The blower fan 1 is a centrifugal fan. The blower fan 1 is, for example, installed in a notebook personal computer (hereinafter referred to as a "notebook PC"), and is used to cool devices inside a case of the notebook PC.

The blower fan 1 includes a motor portion 2, a housing 3, and an impeller 4. The impeller 4 is centered on a central axis J1 extending in a vertical direction. The motor portion 2 is arranged to rotate the impeller 4 about the central axis J1. The housing 3 is arranged to house the motor portion 2 and the impeller 4.

The housing 3 includes an upper plate portion 31, a lower plate portion 32, and a side wall portion 33. The upper plate portion 31 is arranged to cover an upper side of the impeller 4. The lower plate portion 32 is arranged to cover a lower side of the impeller 4. The motor portion 2 is fixed to the lower plate portion 32. The side wall portion 33 is arranged to cover a lateral side of the impeller 4. The upper plate portion 31, the side wall portion 33, and the lower plate portion 32 are arranged to together define an air channel portion 30 arranged to surround the impeller 4.

Each of the upper and lower plate portions 31 and 32 is made of a metal such as an aluminum alloy or stainless steel, and is defined in the shape of a thin plate. The side wall portion 33 is made of an aluminum alloy, and is molded by die casting. Alternatively, the side wall portion 33 may be molded of a resin. A lower end portion of the side wall portion 33 and an edge portion of the lower plate portion 32 are fastened to each other by screws. The upper plate portion 31 is fixed to an upper end portion of the side wall portion 33 by crimping.

Figure 2:
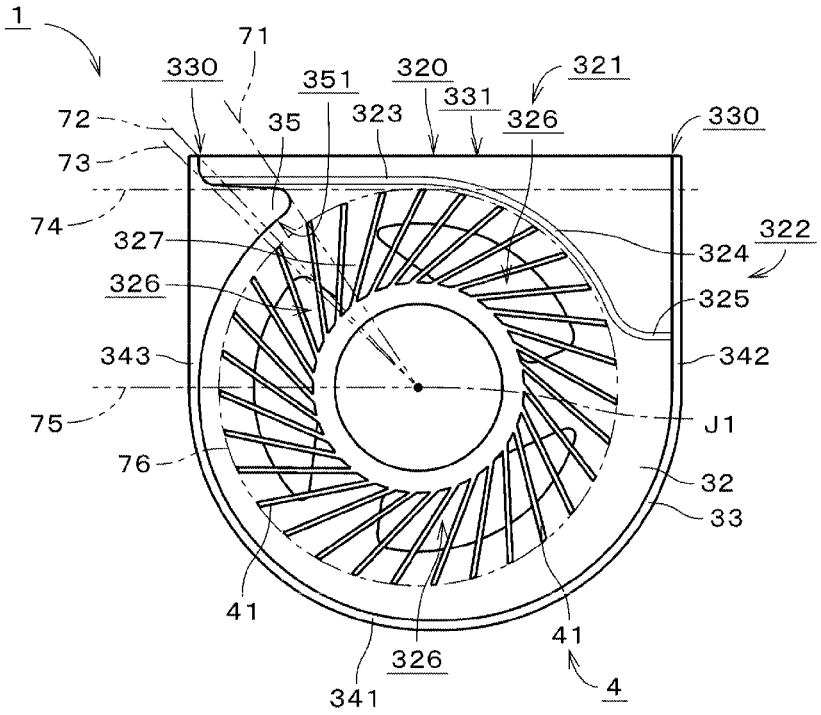
FIG. 2 is a plan view of the blower fan.
Figure 3:
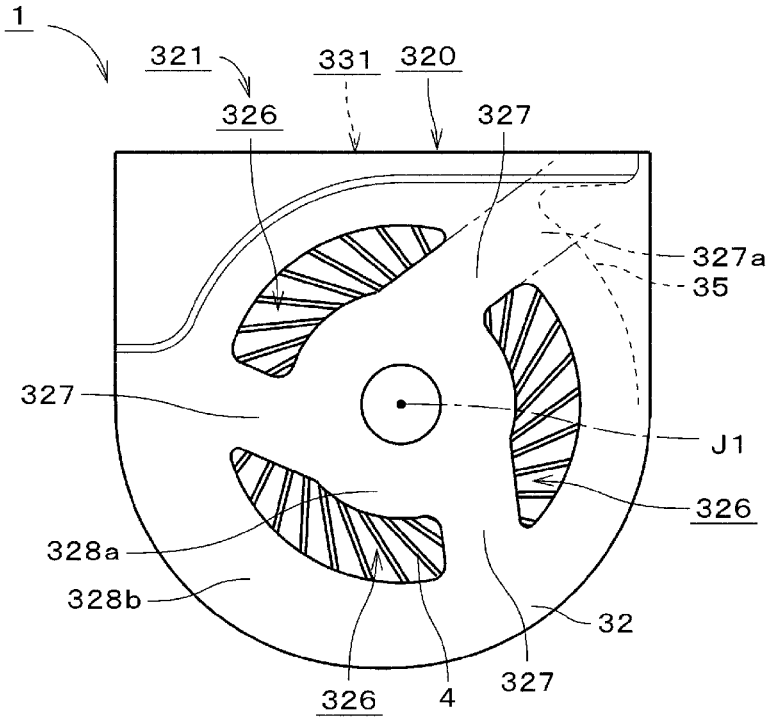
FIG. 3 is a bottom view of the blower fan.

FIG. 2 is a plan view of the blower fan 1. In FIG. 2, the upper plate portion 31 is not shown. FIG. 3 is a bottom view of the blower fan 1. Referring to FIGS. 1 to 3, the lower plate portion 32 includes an air inlet 321. The air inlet 321 is arranged below the impeller 4. The air inlet 321 includes a plurality of openings 326 defined in the lower plate portion 32. The openings 326 are arranged in a circumferential direction, and are centered on the central axis J1. In the blower fan 1, the number of openings 326 defined in the lower plate portion 32 is three.

The upper plate portion 31, the side wall portion 33, and the lower plate portion 32 are arranged to together define an air outlet 331 on the lateral side of the impeller 4. Specifically, the air outlet 331 is defined by an edge 310 of the upper plate portion 31, a pair of edges 330 of the side wall portion 33, and an edge 320 of the lower plate portion 32. The air outlet 331 is planar and parallel to the central axis J1. Lines of intersection of the air outlet 331 and the side wall portion 33 will be referred to as "side edges". Then, the edges 330 are the side edges in the blower fan 1.

In the case where the distance between the central axis J1 and each of the edge 310 of the upper plate portion 31, the pair of edges 330 of the side wall portion 33, and the edge 320 of the lower plate portion 32 is different, the air outlet 331 is planar and parallel to the central axis J1, and includes one of the edges 310, 320, and 330 that is closest to the central axis J1. In the case where ends of the side wall portion 33 are arranged to project beyond the upper plate portion 31 or the lower plate portion 32, that is, ends of the side wall portion 33 are arranged to be more distant from the central axis J1 than is the air outlet 331, the aforementioned side edges are positioned closer to the central axis J1 than are the edges 330 of the side wall portion 33.

Referring to FIG. 1, the motor portion 2 is of an outer-rotor type. The motor portion 2 includes a stationary portion 21, which is a stationary assembly, a rotating portion 22, which is a rotating assembly, and a sleeve 23, which is a bearing. The sleeve 23 is substantially cylindrical and centered on the central axis J1. The rotating portion 22 is supported by the sleeve 23 such that the rotating portion 22 is rotatable about the central axis J1 with respect to the stationary portion 21.

The stationary portion 21 includes a stator 210 and a bearing holding portion 24. The bearing holding portion 24 is arranged to accommodate the sleeve 23. The bearing holding portion 24 is substantially cylindrical and centered on the central axis J1, and is made of a resin. The bearing holding portion 24 is arranged to project upward from a substantial center of the lower plate portion 32. The bearing holding portion 24 is fixed in a hole portion 329 defined in the lower plate portion 32. A lower end portion of the bearing holding portion 24 and a portion of the lower plate portion 32 around the hole portion 329 are joined to each other by an insert molding process.

The stator 210 is annular and centered on the central axis J1. The stator 210 is attached to an outside surface of the bearing holding portion 24. The stator 210 includes a stator core 211, an insulator 212, and coils 213. The stator core 211 is defined by laminated silicon steel sheets, each of which is in the shape of a thin plate. The insulator 212 is made of an insulating material, and is arranged to cover a surface of the stator core 211.

The rotating portion 22 includes a shaft 221, a yoke 222, a rotor magnet 223, and a cup 224. The cup 224 is substantially in the shape of a covered cylinder and centered on the central axis J1. The cup 224 is arranged to be open downwardly. The shaft 221 is centered on the central axis J1, and an upper end portion of the shaft 221 is fixed to the cup 224. The yoke 222 is substantially cylindrical and centered on the central axis J1, and is fixed to an inside surface of the cup 224. The rotor magnet 223 is substantially cylindrical and centered on the central axis J1, and is fixed to an inside surface of the yoke 222.

The shaft 221 is inserted in the sleeve 23. The sleeve 23 is defined by an oil-bearing porous metal body, and is inserted and fixed in the bearing holding portion 24. Note that a ball bearing, for example, may be used as a bearing mechanism.

The impeller 4 includes a plurality of blades 41 and a blade support portion 42. The blade support portion 42 is substantially in the shape of an annular plate and centered on the central axis J1. An inner circumferential portion of the blade support portion 42 is fixed to an outside surface of the cup 224. The blades 41 are arranged in an annular shape radially outside the cup 224, and are centered on the central axis J1. A radially inner end portion of each blade 41 is fixed to an outer circumferential portion of the blade support portion 42. Note that the blade support portion 42 may be omitted, with the radially inner end portion of each blade 41 being directly fixed to an outer circumferential surface of the cup 224.

A torque centered on the central axis J1 is produced between the rotor magnet 223 and the stator 210 as a result of supply of a current to the stationary portion 21. The impeller 4 is thereby caused to rotate about the central axis J1 together with the rotating portion 22. The impeller 4 is arranged to rotate in a counterclockwise direction in FIG. 2. Rotation of the impeller 4 causes an air to be drawn into the housing 3 through the air inlet 321, and to be sent out through the air outlet 331.

Referring to FIG. 2, the side wall portion 33 includes a first side wall portion 341, a second side wall portion 342, and a third side wall portion 343. Each of the first, second, and third side wall portions 341, 342, and 343 is arranged to extend in the vertical direction in parallel with the central axis J1. The first side wall portion 341 is arranged on an opposite side of the air inlet 321 with respect to the air outlet 331.

The first side wall portion 341 is arranged to extend in a curve along an outer circumference of the impeller 4. The first side wall portion 341 is arranged to extend in a circumferential direction about an axis displaced from the central axis J1. An inside surface of the first side wall portion 341 is also arranged to extend in a curve along the outer circumference of the impeller 4. The second side wall portion 342 is arranged to extend in a rotation direction of the impeller 4 from the first side wall portion 341. The third side wall portion 343 is arranged to extend in a counter-rotation direction of the impeller 4 from the first side wall portion 341.

The third side wall portion 343 includes a tongue portion 35 arranged to project between the air outlet 331 and the impeller 4. A side surface 351 of the tongue portion 35 is arranged to extend parallel to the vertical direction from the lower plate portion 32 to the upper plate portion 31. An upper portion of the tongue portion 35 includes a recessed portion (not shown). The amount of a material needed to form the tongue portion 35 is thereby reduced. A lower portion of the tongue portion 35 may also include a recessed portion.

In FIG. 2, chain double-dashed lines 71, 72, and 73 extending from the central axis J1 to the tongue portion 35 represent a first imaginary plane 71, a second imaginary plane 72, and a third imaginary plane 73, respectively. A chain double-dashed line 74 extending in a horizontal direction in FIG. 2 between the impeller 4 and the air outlet 331 represents a fourth imaginary plane 74. A chain double-dashed line 75 extending from the central axis J1 in the horizontal direction in FIG. 2 represents a fifth imaginary plane 75. A chain double-dashed line 76 surrounding the impeller 4 represents an outer envelope 76 which touches radially outer edges of all the blades 41 of the impeller 4.

Each of the first, second, and third imaginary planes 71, 72, and 73 is a plane including the central axis J1. The outer envelope 76 is a cylindrical plane centered on the central axis J1. The fourth imaginary plane 74 is a plane parallel to the air outlet 331 and touching the outer envelope 76. The fifth imaginary plane 75 is a plane including the central axis J1 and parallel to the air outlet 331.

Figure 4:
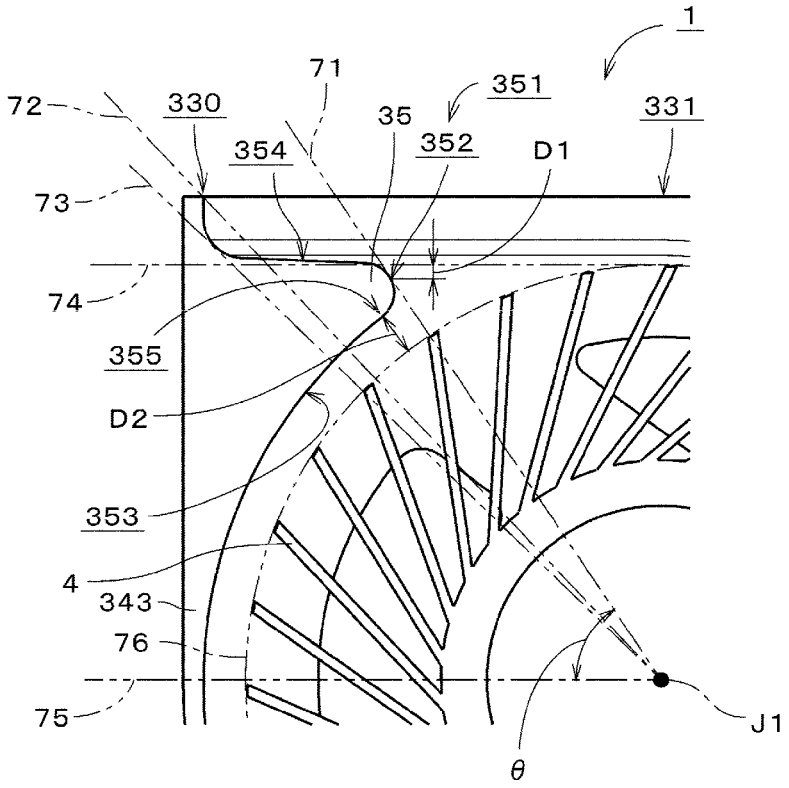
FIG. 4 is a plan view illustrating a tongue portion of the blower fan and its vicinity in an enlarged form.

FIG. 4 is a diagram illustrating the tongue portion 35 illustrated in FIG. 2 and its vicinity in an enlarged form. The side surface 351 of the tongue portion 35 includes a tongue portion tip 352, a first tongue portion side surface 353, and a second tongue portion side surface 354. The tongue portion tip 352 is arranged to touch the first imaginary plane 71 in one straight line extending in the vertical direction. The tongue portion tip 352 is located between the fourth imaginary plane 74 and the outer envelope 76. The first tongue portion side surface 353 is arranged to extend from the tongue portion tip 352 in the rotation direction of the impeller 4 along the outer envelope 76 of the impeller 4. The second tongue portion side surface 354 is arranged to extend from the tongue portion tip 352 toward the edge 330 of the third side wall portion 343. As mentioned above, the edges 330 are the lines of intersection of the air outlet 331 and the side wall portion 33. Each of the first and second tongue portion side surfaces 353 and 354 is preferably a smooth curved surface parallel to the central axis J1. In other words, the first tongue portion side surface 353 is arranged to continuously change in curvature at each point in a plan view, while the second tongue portion side surface 354 is also arranged to continuously change in curvature at each point in the plan view.

The second imaginary plane 72 is a plane which touches the edge 330 of the third side wall portion 343. In other words, the second imaginary plane 72 includes the edge 330, which is one straight line extending in the vertical direction. The second imaginary plane 72 crosses the second tongue portion side surface 354. The third imaginary plane 73 overlaps with the tongue portion 35, and touches the second tongue portion side surface 354 between the tongue portion tip 352 and the edge 330. The third imaginary plane 73 is located between the second imaginary plane 72, which extends from the central axis J1 to the edge 330, and the fifth imaginary plane 75, which extends from the central axis J1 to the third side wall portion 343. The angle θ defined between the first imaginary plane 71 and the fifth imaginary plane 75 in the plan view is preferably greater than 45 degrees and smaller than 90 degrees. More preferably, the angle θ is 50 or more degrees and smaller than 90 degrees.

A closest proximity position 355, at which the first tongue portion side surface 353 and the outer envelope 76 are in closest proximity to each other, is in the shape of a straight line extending in the vertical direction, or in the shape of a strip-shaped curved surface extending parallel to the central axis J1 in the vertical direction. The closest proximity position 355 is located between the first imaginary plane 71, which extends from the central axis J1 to the tongue portion tip 352, and the second imaginary plane 72, which extends from the central axis J1 to the edge 330. Therefore, the closest proximity position 355 is located between the first imaginary plane 71 and the third imaginary plane 73, which extends from the central axis J1 to the second tongue portion side surface 354. The shortest distance D1 between the tongue portion tip 352 and the fourth imaginary plane 74 is preferably equal to or shorter than the shortest distance D2 between the closest proximity position 355 and the outer envelope 76. The distance between the first tongue portion side surface 353 and the outer envelope 76 is arranged to gradually increase in the rotation direction of the impeller 4 with increasing distance from the closest proximity position 355.

Referring to FIG. 2, the width of the air outlet 331 is arranged to be greater than the diameter of the outer envelope 76. Preferably, the air outlet 331 is arranged to have a width greater than the diameter of the outer envelope 76 in any cross-section perpendicular to the central axis J1. More preferably, when the outer envelope 76 is perpendicularly projected onto the air outlet 331, the entire outer envelope 76 is included in the air outlet 331.

Referring to FIG. 2, the lower plate portion 32 includes a shoulder portion 322 arranged to traverse an area between the air outlet 331 and the impeller 4. The shoulder portion 322 is arranged to extend from the third side wall portion 343 to reach the second side wall portion 342. A portion of the lower plate portion 32 which extends between the air outlet 331 and the shoulder portion 322 is positioned lower than a remaining portion of the lower plate portion 32, and is therefore more distant from the upper plate portion 31 in the vertical direction than is the remaining portion. In other words, the vertical distance between the upper and lower plate portions 31 and 32 is longer in an area between the air outlet 331 and the shoulder portion 322 than in a remaining area.

The shoulder portion 322 includes a first shoulder portion 323, a second shoulder portion 324, and a third shoulder portion 325. The first, second, and third shoulder portions 323, 324, and 325 are arranged in the order named from the third side wall portion 343 toward the second side wall portion 342. The first, second, and third shoulder portions 323, 324, and 325 are continuous with one another.

The first shoulder portion 323 is located between the air outlet 331 and the fourth imaginary plane 74, and is arranged to extend from the second tongue portion side surface 354 substantially in parallel with the fourth imaginary plane 74 in the vicinity of the fourth imaginary plane 74 in the plan view. The first shoulder portion 323 is arranged to extend toward the outer envelope 76 and reach a vicinity of a position at which the fourth imaginary plane 74 touches the outer envelope 76. The second shoulder portion 324 is located between the air outlet 331 and the outer envelope 76, and is arranged to extend in the counter-rotation direction of the impeller 4 from an end portion of the first shoulder portion 323 along the outer envelope 76 in the plan view. In other words, the second shoulder portion 324 is arranged to extend along the outer envelope 76 in a direction away from both the second tongue portion side surface 354 and the air outlet 331. The third shoulder portion 325 is located between the fourth imaginary plane 74 and the central axis J1 with respect to a direction perpendicular to the air outlet 331. The third shoulder portion 325 is arranged to extend from an end portion of the second shoulder portion 324 to the second side wall portion 342 substantially in parallel with the fourth imaginary plane 74 in the plan view.

Referring to FIG. 3, the lower plate portion 32 includes a plurality of ribs 327. The ribs 327 are arranged between the openings 326. Each of the ribs 327 is arranged to join a plate central portion 328*a*, which is a portion of the lower plate portion 32 radially inside the openings 326, and a plate outer circumferential portion 328*b*, which is a portion of the lower plate portion 32 radially outside the openings 326, to each other. In other words, the plate central portion 328*a* is supported by the plate outer circumferential portion 328*b* through the ribs 327.

The number of ribs 327 provided in the lower plate portion 32 of the blower fan 1 is three. It is assumed that an imaginary extension, into the plate outer circumferential portion 328*b*, of one of the three ribs 327 that is the closest to the air outlet 331 is referred to as an imaginary extension portion 327*a*. Then, the imaginary extension portion 327*a* overlaps with the tongue portion 35 in the plan view. Moreover, referring to FIG. 2, the rib 327 that is the closest to the air outlet 331 overlaps with the first imaginary plane 71 throughout its entire length. In other words, the three openings 326 of the air inlet 321 are arranged to avoid the first imaginary plane 71.

As described above, in the blower fan 1, the tongue portion 35 arranged to project between the air outlet 331 and the impeller 4 is provided in the side wall portion 33. The first tongue portion side surface 353 is arranged to extend from the tongue portion tip 352 along the outer envelope 76 of the impeller 4, while the second tongue portion side surface 354 is arranged to extend from the tongue portion tip 352 toward the edge 330, i.e., the side edge. The closest proximity position 355, at which the first tongue portion side surface 353 and the outer envelope 76 are in closest proximity to each other, is located between the aforementioned first imaginary plane 71 and the aforementioned third imaginary plane 73. The second tongue portion side surface 354 is arranged to cross the second imaginary plane 72.

The above arrangements allow a wind blowing from the impeller 4 toward the tongue portion 35 to be smoothly guided toward the air outlet 331 along the second tongue portion side surface 354. This reduces the likelihood that any wind blowing toward the tongue portion 35 will strike hard against the second tongue portion side surface 354, and thereby reduces noise caused by a collision between the wind and the second tongue portion side surface 354 or the like. In other words, the blower fan 1 is so structured that noise caused by interference of any wind sent from the impeller 4 with the tongue portion 35 is reduced. Moreover, the closest proximity position 355 being located in the vicinity of the tongue portion tip 352 contributes to reducing the likelihood that any wind blowing from the impeller 4 toward the tongue portion 35 will flow into a space between the first tongue portion side surface 353 and the impeller 4. This results in an increase in the volume of air sent out through the air outlet 331. Moreover, an increase in the length of the air channel portion 30, which extends from the closest proximity position 355 in the rotation direction of the impeller 4, is achieved. This results in an efficient increase in static pressure in the air channel portion 30.

In the blower fan 1, the closest proximity position 355 is located between the first and second imaginary planes 71 and 72. This causes the closest proximity position 355 to be located even closer to the tongue portion tip 352, so that an additional increase in the volume of air sent out through the air outlet 331 is achieved. Moreover, a more efficient increase in the static pressure in the air channel portion 30 is also achieved.

As described above, the tongue portion tip 352 is located between the outer envelope 76 and the fourth imaginary plane 74. This contributes to reducing the shortest distance D2 between the closest proximity position 355 and the outer envelope 76, and thereby further reducing the likelihood that any wind blowing from the impeller 4 toward the tongue portion 35 will flow into the space between the first tongue portion side surface 353 and the impeller 4. This results in an additional increase in the volume of air sent out through the air outlet 331. Moreover, an additional increase in the length of the air channel portion 30, which extends from the closest proximity position 355 in the rotation direction of the impeller 4, is achieved. This results in a more efficient increase in the static pressure in the air channel portion 30.

The shortest distance D1 between the tongue portion tip 352 and the fourth imaginary plane 74 is equal to or shorter than the shortest distance D2 between the closest proximity position 355 and the outer envelope 76. This leads to a greater extent of projection of the tongue portion 35. In other words, an increase in the distance between the tongue portion tip 352 and the edge 330 is achieved with respect to a direction perpendicular to the central axis J1 and parallel to the air outlet 331. This results in an additional reduction in the shortest distance D2 and an additional increase in the volume of air sent out through the air outlet 331. A more efficient increase in the static pressure in the air channel portion 30 is also achieved.

The angle θ defined between the first and fifth imaginary planes 71 and 75 is greater than 45 degrees. This leads to a large extent of the projection of the tongue portion 35. This further reduces the likelihood that any wind blowing from the impeller 4 toward the tongue portion 35 will flow into the space between the first tongue portion side surface 353 and the impeller 4. This results in an additional increase in the volume of air sent out through the air outlet 331. Moreover, an increase in the length of the air channel portion 30 is achieved, leading to a more efficient increase in the static pressure in the air channel portion 30.

More preferably, the angle θ is arranged to be 50 or more degrees. This leads to an additional increase in the extent of the projection of the tongue portion 35. This results in an additional increase in the volume of air sent out through the air outlet 331. A more efficient increase in the static pressure in the air channel portion 30 is also achieved. The angle θ being less than 90 degrees prevents the tongue portion 35 from projecting so excessively as to cause an excessively large size of the blower fan 1.

As described above, the second tongue portion side surface 354 is a smooth curved surface. This allows any wind blowing from the impeller 4 toward the tongue portion 35 to be more smoothly guided to the air outlet 331 along the second tongue portion side surface 354. This results in an additional reduction in the noise caused by the interference of any wind sent from the impeller 4 with the tongue portion 35. Moreover, an additional increase in the volume of air sent out through the air outlet 331 is also achieved. The air outlet 331 is arranged to have a width greater than the diameter of the outer envelope 76 in a cross-section perpendicular to the central axis J1. As a result, an additional increase in the volume of air sent out through the air outlet 331 is achieved. Moreover, the blower fan 1 is thereby made able to efficiently send an air even to an object such as a heat sink having a large width.

The shoulder portion 322 arranged to traverse the area between the air outlet 331 and the impeller 4 is provided in the lower plate portion 32. The portion of the lower plate portion 32 which extends between the air outlet 331 and the shoulder portion 322 is more distant from the upper plate portion 31 in the vertical direction than is the remaining portion of the lower plate portion 32. In the blower fan 1, the first shoulder portion 323 extending from the second tongue portion side surface 354 toward the outer envelope 76 contributes to increasing the size of a space in which a wind blows from the impeller 4 toward the air outlet 331 in a direction parallel to the air outlet 331. This results in an increase in the volume of air sent out through the air outlet 331.

In the shoulder portion 322, more preferably, the second shoulder portion 324 is arranged to extend along the outer envelope 76. This contributes to increasing the size of the space in which the wind blows from the impeller 4 toward the air outlet 331 while preventing an additional space from overlapping with the impeller 4. More preferably, the third shoulder portion 325 is arranged to extend from the outer envelope 76 toward the second side wall portion 342 between the central axis J1 and the fourth imaginary plane 74. The third shoulder portion 325 being provided at a position where the wind blows substantially perpendicularly toward the air outlet 331 as described above contributes to efficiently changing orientation of a wind blowing along the rotation direction of the impeller 4 to a direction substantially perpendicular to the air outlet 331. This results in an additional increase in the volume of air sent out through the air outlet 331.

In the lower plate portion 32, the imaginary extension portion 327*a*, i.e., the imaginary extension of the one of the three ribs 327 that is the closest to the air outlet 331, overlaps with the tongue portion 35 in the plan view. As a result, the plate central portion 328*a* is securely supported by the plate outer circumferential portion 328*b*. As a result, vibrations of the plate central portion 328*a* caused by drive of the motor portion 2 are reduced, and a reduction in noise caused by these vibrations is achieved.

Furthermore, since the three openings 326 of the air inlet 321 are arranged to avoid the first imaginary plane 71, a large opening, i.e., one of the openings 326, is arranged below the impeller 4 in an area extending from the second side wall portion 342 toward the tongue portion 35 along the rotation direction of the impeller 4. This results in an increase in the amount of air supplied to this area, leading to a reduced reduction in static pressure in this area.

Second Preferred Embodiment

Figure 5:
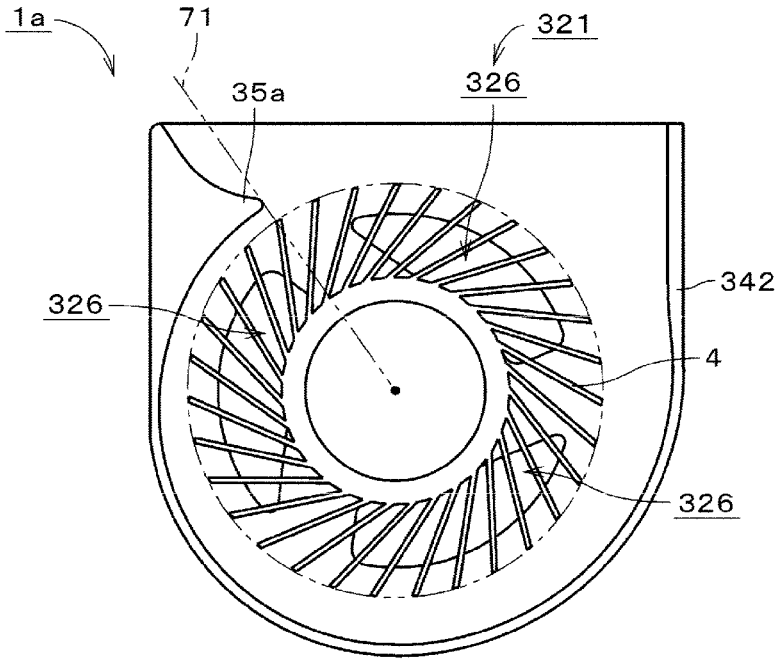
FIG. 5 is a plan view of a blower fan according to a second preferred embodiment of the present invention.
Figure 6:
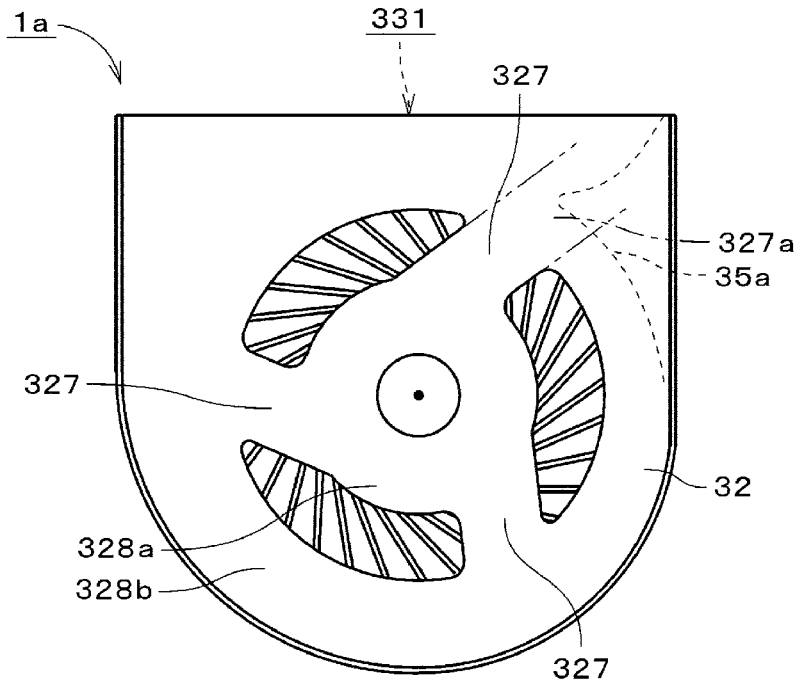
FIG. 6 is a bottom view of the blower fan.

FIG. 5 is a plan view of a blower fan 1*a* according to a second preferred embodiment of the present invention. In FIG. 5, an upper plate portion 31 is not shown. FIG. 6 is a bottom view of the blower fan 1*a*. The blower fan 1*a* includes a tongue portion 35*a* having a shape different from that of the tongue portion 35 of the blower fan 1 illustrated in FIG. 2. The blower fan 1*a* is otherwise similar in structure to the blower fan 1. Accordingly, like members or portions are designated by like reference numerals.

Figure 7:
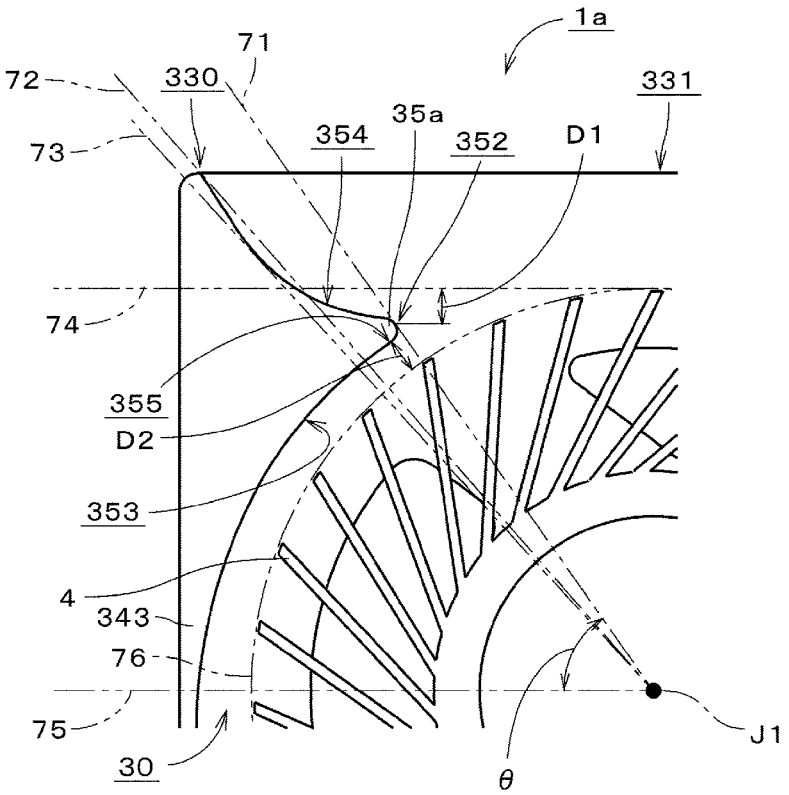
FIG. 7 is a plan view illustrating a tongue portion of the blower fan and its vicinity in an enlarged form.

FIG. 7 is a diagram illustrating the tongue portion 35*a* illustrated in FIG. 5 and its vicinity in an enlarged form. A tongue portion tip 352 of the tongue portion 35*a* touches a first imaginary plane 71 including a central axis J1 in one straight line extending in the vertical direction. A second tongue portion side surface 354 crosses a second imaginary plane 72. The second imaginary plane 72 includes the central axis J1 and an edge 330 which is a side edge. In other words, the second imaginary plane 72 is a plane which touches the edge 330 of a third side wall portion 343. A closest proximity position 355, at which a first tongue portion side surface 353 and an outer envelope 76 of an impeller 4 are in closest proximity to each other, is located between the first imaginary plane 71 and a third imaginary plane 73. The third imaginary plane 73 includes the central axis J1, overlaps with the tongue portion 35*a*, and touches the second tongue portion side surface 354 between the tongue portion tip 352 and the edge 330.

This causes a wind blowing from the impeller 4 toward the tongue portion 35*a* to be smoothly guided toward an air outlet 331 along the second tongue portion side surface 354 as in the case of the blower fan 1. As a result, noise caused by interference of any wind sent from the impeller 4 with the tongue portion 35*a* is reduced. Moreover, the likelihood that any wind blowing from the impeller 4 toward the tongue portion 35*a* will flow into a space between the first tongue portion side surface 353 and the impeller 4 is reduced. This results in an increase in the volume of air sent out through the air outlet 331. Moreover, an increase in the length of an air channel portion 30 extending from the closest proximity position 355 in the rotation direction of the impeller 4 is achieved. This results in an efficient increase in static pressure in the air channel portion 30.

The closest proximity position 355 is located between the first and second imaginary planes 71 and 72. This causes the closest proximity position 355 to be located even closer to the tongue portion tip 352, so that an additional increase in the volume of air sent out through the air outlet 331 is achieved. Moreover, a more efficient increase in the static pressure in the air channel portion 30 is also achieved.

The tongue portion tip 352 is located between the outer envelope 76 and a fourth imaginary plane 74 which is a plane parallel to the air outlet 331 and touching the outer envelope 76. This contributes to reducing the shortest distance D2 between the closest proximity position 355 and the outer envelope 76, and thereby further reducing the likelihood that any wind blowing from the impeller 4 toward the tongue portion 35*a* will flow into the space between the first tongue portion side surface 353 and the impeller 4. This results in an additional increase in the volume of air sent out through the air outlet 331. Moreover, an additional increase in the length of the air channel portion 30, which extends from the closest proximity position 355 in the rotation direction of the impeller 4, is achieved. This results in a more efficient increase in the static pressure in the air channel portion 30.

The shortest distance D1 between the tongue portion tip 352 and the fourth imaginary plane 74 is arranged to be equal to or shorter than the shortest distance D2 between the closest proximity position 355 and the outer envelope 76. This leads to a greater extent of projection of the tongue portion 35*a*. This results in an additional reduction in the shortest distance D2 and an additional increase in the volume of air sent out through the air outlet 331. Moreover, a more efficient increase in the static pressure in the air channel portion 30 is also achieved.

The angle θ defined between the first imaginary plane 71 and a fifth imaginary plane 75 which is a plane including the central axis J1 and being parallel to the air outlet 331 is arranged to be greater than 45 degrees, more preferably, 50 or more degrees. This leads to an increase in the extent of the projection of the tongue portion 35*a*. This results in an additional increase in the volume of air sent out through the air outlet 331. A more efficient increase in the static pressure in the air channel portion 30 is also achieved. Moreover, the angle θ being less than 90 degrees prevents the tongue portion 35*a* from projecting so excessively as to cause an excessively large size of the blower fan 1*a*.

The second tongue portion side surface 354 is a smooth curved surface. An additional reduction in noise caused by interference of any wind sent from the impeller 4 with the tongue portion 35*a* is thereby achieved. An additional increase in the volume of air sent out through the air outlet 331 is also achieved. The air outlet 331 is arranged to have a width greater than the diameter of the outer envelope 76 in a cross-section perpendicular to the central axis J1. As a result, an additional increase in the volume of air sent out through the air outlet 331 is achieved. Moreover, the blower fan 1*a* is thereby made able to efficiently send an air even to an object such as a heat sink having a large width.

Referring to FIG. 6, in a lower plate portion 32, an imaginary extension portion 327*a*, i.e., an imaginary extension of a rib 327 that is the closest to the air outlet 331, overlaps with the tongue portion 35*a* in a plan view. As a result, a plate central portion 328*a* is securely supported by a plate outer circumferential portion 328*b*. As a result, vibrations of the plate central portion 328*a* caused by drive of a motor portion 2 are reduced, and a reduction in noise caused by these vibrations is achieved.

Furthermore, referring to FIG. 5, since three openings 326 of an air inlet 321 are arranged to avoid the first imaginary plane 71, a large opening, i.e., one of the openings 326, is arranged below the impeller 4 in an area extending from a second side wall portion 342 toward the tongue portion 35*a* along the rotation direction of the impeller 4. This results in an increase in the amount of air supplied to this area, leading to a reduced reduction in static pressure in this area.

Third Preferred Embodiment

Figure 8:
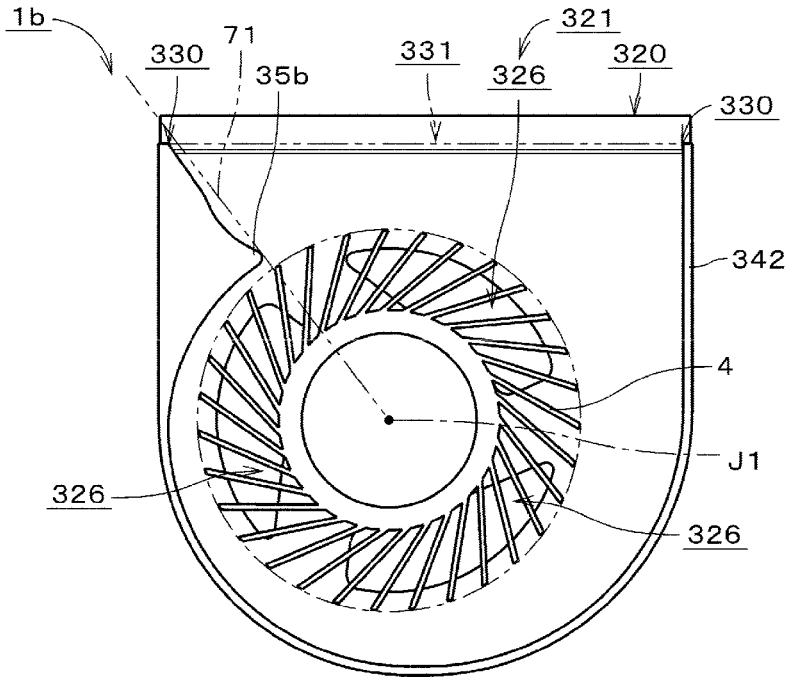
FIG. 8 is a plan view of a blower fan according to a third preferred embodiment of the present invention.
Figure 9:
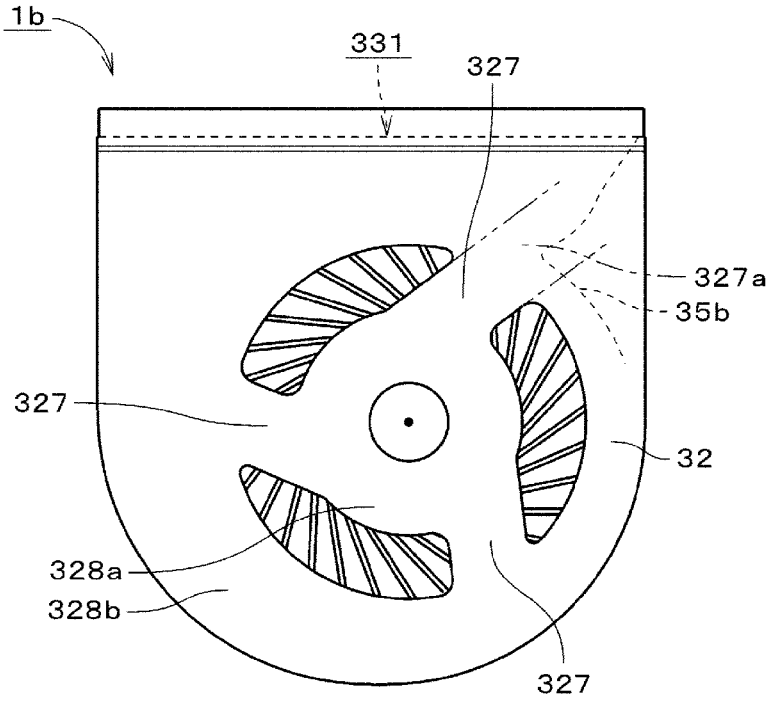
FIG. 9 is a bottom view of the blower fan.

FIG. 8 is a plan view of a blower fan 1*b* according to a third preferred embodiment of the present invention. In FIG. 8, an upper plate portion 31 is not shown. FIG. 9 is a bottom view of the blower fan 1*b*. The blower fan 1*b* includes a tongue portion 35*b* having a shape different from that of the tongue portion 35 of the blower fan 1 illustrated in FIG. 2. The blower fan 1*b* is otherwise similar in structure to the blower fan 1. Accordingly, like members or portions are designated by like reference numerals.

Referring to FIG. 8, in the blower fan 1*b*, an edge 320 of a lower plate portion 32 is arranged to be more distant from a central axis J1 than are a pair of edges 330 of a side wall portion 33. Therefore, an air outlet 331 is located at a position represented by a chain double-dashed line in FIG. 8. The air outlet 331 includes the pair of edges 330, but does not include the edge 320 of the lower plate portion 32. The air outlet 331 is located between the edge 320 and the central axis J1.

Figure 10:
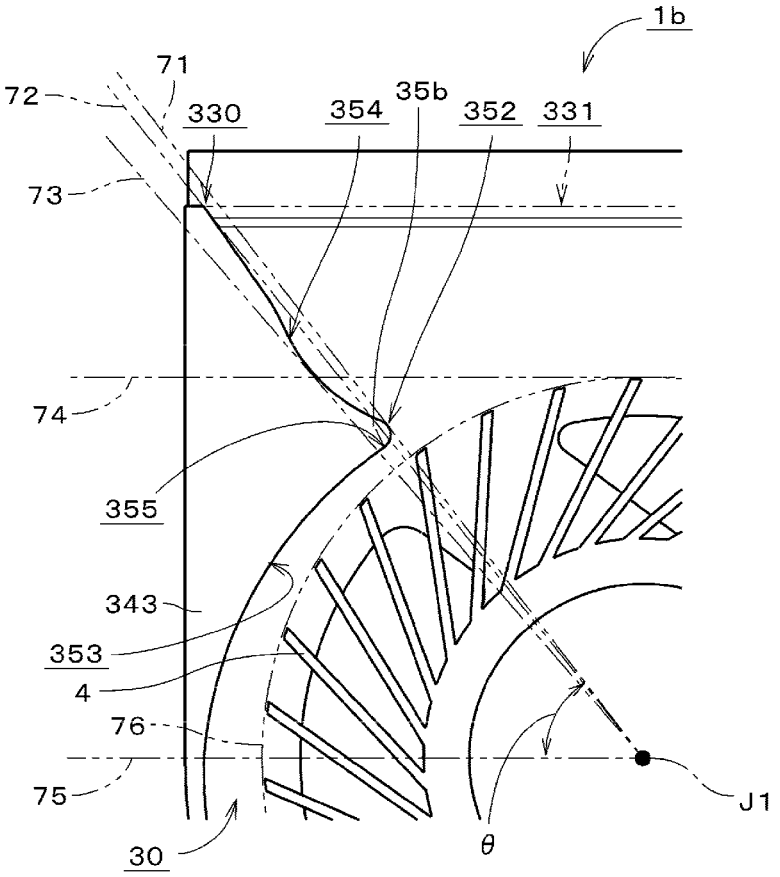
FIG. 10 is a plan view illustrating a tongue portion of the blower fan and its vicinity in an enlarged form.

FIG. 10 is a diagram illustrating the tongue portion 35*b* illustrated in FIG. 8 and its vicinity in an enlarged form. A tongue portion tip 352 of the tongue portion 35*b* touches a first imaginary plane 71 including the central axis J1 in one straight line extending in the vertical direction. A second tongue portion side surface 354 crosses a second imaginary plane 72. The second imaginary plane 72 includes the central axis J1 and the edge 330, which is a side edge. In other words, the second imaginary plane 72 is a plane which touches the edge 330 of a third side wall portion 343. A closest proximity position 355, at which a first tongue portion side surface 353 and an outer envelope 76 of an impeller 4 are in closest proximity to each other, is located between the first imaginary plane 71 and a third imaginary plane 73. The third imaginary plane 73 includes the central axis J1, overlaps with the tongue portion 35*b*, and touches the second tongue portion side surface 354 between the tongue portion tip 352 and the edge 330.

This causes a wind blowing from the impeller 4 toward the tongue portion 35*b* to be smoothly guided toward the air outlet 331 along the second tongue portion side surface 354 as in the case of the blower fan 1. As a result, noise caused by interference of any wind sent from the impeller 4 with the tongue portion 35*b* is reduced. Moreover, the likelihood that any wind blowing from the impeller 4 toward the tongue portion 35*b* will flow into a space between the first tongue portion side surface 353 and the impeller 4 is reduced. This results in an increase in the volume of air sent out through the air outlet 331. Moreover, an increase in the length of an air channel portion 30 extending from the closest proximity position 355 in the rotation direction of the impeller 4 is achieved. This results in an efficient increase in static pressure in the air channel portion 30.

The tongue portion tip 352 is located between the outer envelope 76 and a fourth imaginary plane 74 which is a plane parallel to the air outlet 331 and touching the outer envelope 76. This contributes to reducing the shortest distance between the closest proximity position 355 and the outer envelope 76, and thereby further reducing the likelihood that any wind blowing from the impeller 4 toward the tongue portion 35*b* will flow into the space between the first tongue portion side surface 353 and the impeller 4. This results in an additional increase in the volume of air sent out through the air outlet 331. Moreover, an additional increase in the length of the air channel portion 30, which extends from the closest proximity position 355 in the rotation direction of the impeller 4, is achieved. This results in a more efficient increase in the static pressure in the air channel portion 30.

The angle θ defined between the first imaginary plane 71 and a fifth imaginary plane 75 which is a plane including the central axis J1 and being parallel to the air outlet 331 is arranged to be greater than 45 degrees, more preferably, 50 or more degrees. This leads to an increase in the extent of projection of the tongue portion 35*b*. This results in an additional increase in the volume of air sent out through the air outlet 331. A more efficient increase in the static pressure in the air channel portion 30 is also achieved. Moreover, the angle θ being less than 90 degrees prevents the tongue portion 35*b* from projecting so excessively as to cause an excessively large size of the blower fan 1*b*.

The second tongue portion side surface 354 includes a smooth curved surface extending from the tongue portion tip 352. An additional reduction in noise caused by interference of any wind sent from the impeller 4 with the tongue portion 35*b* is thereby achieved. An additional increase in the volume of air sent out through the air outlet 331 is also achieved. The air outlet 331 is arranged to have a width greater than the diameter of the outer envelope 76 in a cross-section perpendicular to the central axis J1. As a result, an additional increase in the volume of air sent out through the air outlet 331 is achieved. Moreover, the blower fan 1*b* is thereby made able to efficiently send an air even to an object such as a heat sink having a large width.

Referring to FIG. 9, in the lower plate portion 32, an imaginary extension portion 327*a*, i.e., an imaginary extension of a rib 327 that is the closest to the air outlet 331, overlaps with the tongue portion 35*b* in a plan view. As a result, a plate central portion 328*a* is securely supported by a plate outer circumferential portion 328*b*. As a result, vibrations of the plate central portion 328*a* caused by drive of a motor portion 2 are reduced, and a reduction in noise caused by these vibrations is achieved.

Furthermore, referring to FIG. 8, since three openings 326 of an air inlet 321 are arranged to avoid the first imaginary plane 71, a large opening, i.e., one of the openings 326, is arranged below the impeller 4 in an area extending from a second side wall portion 342 toward the tongue portion 35*b* along the rotation direction of the impeller 4. This results in an increase in the amount of air supplied to this area, leading to a reduced reduction in static pressure in this area.

Each of the blower fans 1, 1*a*, and 1*b* described above may be modified in a variety of manners.

In the blower fan 1, the side surface 351 of the tongue portion 35 may be a surface inclined with respect to the vertical direction. In this case, the first imaginary plane 71 is an imaginary plane which touches the tongue portion tip 352 at a point, the second imaginary plane 72 is an imaginary plane which includes the central axis J1 and which touches the edge 330 of the side wall portion 33 at a point, and the closest proximity position 355, at which the first tongue portion side surface 353 and the outer envelope 76 are in closest proximity to each other, is a point or a curve extending along the outer envelope 76 in the horizontal direction. The same is true of each of the blower fans 1*a* and 1*b*.

In a modification of any of the blower fans 1, 1*a*, and 1*b*, the air inlet 321 may be provided in each of the upper and lower plate portions 31 and 32 or in only the upper plate portion 31. In other words, it is enough that the upper plate portion 31 or the lower plate portion 32 should include the air inlet 321. The air inlet 321 may include only one opening 326, or may include two or more than three openings 326. In any of the above cases, each of the openings 326 of the air inlet 321 is arranged to avoid the first imaginary plane 71, and a large opening 326 or openings 326 having a large total size are thereby arranged below the impeller 4 in the area extending from the second side wall portion 342 toward the tongue portion 35, 35*a*, or 35*b* along the rotation direction of the impeller 4. This results in an increase in the amount of air supplied to this area, leading to a reduced reduction in the static pressure in this area.

The tongue portion tip 352 may be located between the air outlet 331 and the fourth imaginary plane 74. Even in this case, the shortest distance between the tongue portion tip 352 and the fourth imaginary plane 74 is preferably arranged to be equal to or shorter than the shortest distance between the closest proximity position 355 and the outer envelope 76. This contributes to reducing the likelihood that any wind blowing from the impeller 4 toward the tongue portion 35, 35*a*, or 35*b* will flow into the space between the first tongue portion side surface 353 and the impeller 4. Moreover, an efficient increase in the static pressure in the air channel portion 30 is also achieved.

The shoulder portion 322 of the blower fan 1 may be provided in each of the upper and lower plate portions 31 and 32, or in only the upper plate portion 31. In other words, the shoulder portion 322 is provided in at least one of the upper and lower plate portions 31 and 32. A portion of each of the at least one plate portion which extends between the air outlet 331 and the shoulder portion 322 is arranged to be more distant from the other plate portion in the vertical direction than is a remaining portion thereof.

In a modification of the blower fan 1, the upper plate portion 31 may be omitted from the housing 3. In this case, the upper end portion of the side wall portion 33 is fixed to the case of the notebook PC to which the blower fan 1 is attached, and the upper side of the impeller 4 is covered with the case. That is, a portion of the case of the notebook PC serves as the upper plate portion. The same is true of each of the blower fans 1*a* and 1*b*.

The structure of each of the tongue portions 35, 35*a*, and 35*b* described above may be applied to a blower fan in which two air outlets are provided on a lateral side of an impeller. For example, the two air outlets may be provided in two adjacent sides. In this case, the structure of the tongue portion 35, 35*a*, or 35*b* is applied to at least one of a first tongue portion provided between the two adjacent air outlets and a second tongue portion provided in a portion of the side wall portion near and downstream of the air outlet located downstream with respect to the rotation direction of the impeller.

Features of the above-described preferred embodiments and the modifications thereof may be combined appropriately as long as no conflict arises.

Centrifugal fans according to preferred embodiments of the present invention are usable to cool devices inside cases of notebook PCs and desktop PCs, to cool other devices, to supply an air to a variety of objects, and so on. Moreover, centrifugal fans according to preferred embodiments of the present invention are also usable for other purposes.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower fan comprising:

an impeller centered on a central axis extending in a vertical direction;

a motor portion arranged to rotate the impeller about the central axis; and a housing arranged to house the impeller; wherein the housing includes:

a lower plate portion arranged to cover a lower side of the impeller, and arranged to have the motor portion fixed thereto; and a side wall portion arranged to cover a lateral side of the impeller;

the lower plate portion or an upper plate portion arranged to cover an upper side of the impeller includes an air inlet;

the upper plate portion, the side wall portion, and the lower plate portion are arranged to together define an air channel portion arranged to surround the impeller;

the upper plate portion, the side wall portion, and the lower plate portion are arranged to together define an air outlet on the lateral side of the impeller;

the air outlet is planar and parallel to the central axis, and includes one of an edge of the upper plate portion, a pair of edges of the side wall portion, and an edge of the lower plate portion that is closest to the central axis;

the side wall portion includes a tongue portion arranged to project between the air outlet and the impeller;

a side surface of the tongue portion includes:

a tongue portion tip arranged to touch a first imaginary plane including the central axis;

a first tongue portion side surface arranged to extend from the tongue portion tip along an outer envelope of the impeller; and a second tongue portion side surface arranged to extend from the tongue portion tip toward a side edge, the side edge being a line of intersection of the air outlet and the side wall portion;

the second tongue portion side surface is arranged to cross a second imaginary plane including the central axis and touching the side edge; and a closest proximity position, at which the first tongue portion side surface and the outer envelope are in closest proximity to each other, is located between the first imaginary plane and a third imaginary plane including the central axis and touching the second tongue portion side surface between the tongue portion tip and the side edge, wherein the tongue portion tip is located between the outer envelope and a fourth imaginary plane parallel to the air outlet and touching the outer envelope.

2. The blower fan according to claim 1, wherein the closest proximity position is located between the first and second imaginary planes.

3. The blower fan according to claim 1, wherein the air outlet is arranged to have a width greater than a diameter of the outer envelope in a cross-section perpendicular to the central axis.

4. The blower fan according to claim 1, wherein the second tongue portion side surface is a smooth curved surface.

5. The blower fan according to claim 1, wherein a shortest distance between the tongue portion tip and a fourth imaginary plane parallel to the air outlet and touching the outer envelope is arranged to be equal to or shorter than a shortest distance between the closest proximity position and the outer envelope.

6. The blower fan according to claim 1, wherein an angle defined between the first imaginary plane and a fifth imaginary plane including the central axis and parallel to the air outlet is arranged to be greater than 45 degrees and smaller than 90 degrees.

7. The blower fan according to claim 6, wherein the angle defined between the first and fifth imaginary planes is arranged to be 50 or more degrees and smaller than 90 degrees.

8. The blower fan according to claim 1, wherein one of the upper and lower plate portions includes a shoulder portion arranged to traverse an area between the air outlet and the impeller;

a portion of the one of the upper and lower plate portions which extends between the air outlet and the shoulder portion is arranged to be more distant from another one of the upper and lower plate portions in the vertical direction than is a remaining portion of the one of the upper and lower plate portions; and the shoulder portion includes a first shoulder portion arranged to extend from the second tongue portion side surface toward the outer envelope of the impeller in a plan view.

9. The blower fan according to claim 8, wherein the shoulder portion further includes a second shoulder portion arranged to extend from an end portion of the first shoulder portion along the outer envelope in a direction away from both the second tongue portion side surface and the air outlet in the plan view, and a third shoulder portion arranged to extend from an end portion of the second shoulder portion to the side wall portion between the central axis and a fourth imaginary plane with respect to a direction perpendicular to the air outlet in the plan view, the fourth imaginary plane being parallel to the air outlet and touching the outer envelope.

10. The blower fan according to claim 1, wherein the air inlet is arranged to avoid the first imaginary plane.

11. A blower fan comprising:

an impeller centered on a central axis extending in a vertical direction;

a motor portion arranged to rotate the impeller about the central axis; and a housing arranged to house the impeller; wherein the housing includes:

a lower plate portion arranged to cover a lower side of the impeller, and arranged to have the motor portion fixed thereto; and a side wall portion arranged to cover a lateral side of the impeller;

the lower plate portion or an upper plate portion arranged to cover an upper side of the impeller includes an air inlet;

the upper plate portion, the side wall portion, and the lower plate portion are arranged to together define an air channel portion arranged to surround the impeller;

the upper plate portion, the side wall portion, and the lower plate portion are arranged to together define an air outlet on the lateral side of the impeller;

the air outlet is planar and parallel to the central axis, and includes one of an edge of the upper plate portion, a pair of edges of the side wall portion, and an edge of the lower plate portion that is closest to the central axis;

the side wall portion includes a tongue portion arranged to project between the air outlet and the impeller;

a side surface of the tongue portion includes:

a tongue portion tip arranged to touch a first imaginary plane including the central axis;

a first tongue portion side surface arranged to extend from the tongue portion tip along an outer envelope of the impeller; and a second tongue portion side surface arranged to extend from the tongue portion tip toward a side edge, the side edge being a line of intersection of the air outlet and the side wall portion;

the second tongue portion side surface is arranged to cross a second imaginary plane including the central axis and touching the side edge; and a closest proximity position, at which the first tongue portion side surface and the outer envelope are in closest proximity to each other, is located between the first and second imaginary planes, wherein the tongue portion tip is located between the outer envelope and a fourth imaginary plane parallel to the air outlet and touching the outer envelope.

12. The blower fan according to claim 11, wherein the air outlet is arranged to have a width greater than a diameter of the outer envelope in a cross-section perpendicular to the central axis.

13. The blower fan according to claim 11, wherein the second tongue portion side surface is a smooth curved surface.

14. The blower fan according to claim 11, wherein a shortest distance between the tongue portion tip and a fourth imaginary plane parallel to the air outlet and touching the outer envelope is arranged to be equal to or shorter than a shortest distance between the closest proximity position and the outer envelope.

15. The blower fan according to claim 11, wherein an angle defined between the first imaginary plane and a fifth imaginary plane including the central axis and parallel to the air outlet is arranged to be greater than 45 degrees and smaller than 90 degrees.

16. The blower fan according to claim 15, wherein the angle defined between the first and fifth imaginary planes is arranged to be 50 or more degrees and smaller than 90 degrees.

17. The blower fan according to claim 11, wherein one of the upper and lower plate portions includes a shoulder portion arranged to traverse an area between the air outlet and the impeller;

a portion of the one of the upper and lower plate portions which extends between the air outlet and the shoulder portion is arranged to be more distant from another one of the upper and lower plate portions in the vertical direction than is a remaining portion of the one of the upper and lower plate portions; and the shoulder portion includes a first shoulder portion arranged to extend from the second tongue portion side surface toward the outer envelope of the impeller in a plan view.

18. The blower fan according to claim 17, wherein the shoulder portion further includes a second shoulder portion arranged to extend from an end portion of the first shoulder portion along the outer envelope in a direction away from both the second tongue portion side surface and the air outlet in the plan view, and a third shoulder portion arranged to extend from an end portion of the second shoulder portion to the side wall portion between the central axis and a fourth imaginary plane with respect to a direction perpendicular to the air outlet in the plan view, the fourth imaginary plane being parallel to the air outlet and touching the outer envelope.

19. The blower fan according to claim 11, wherein the air inlet is arranged to avoid the first imaginary plane.

* * * * *